US012577750B2

(12) United States Patent
Smulders et al.

(10) Patent No.: US 12,577,750 B2
(45) Date of Patent: Mar. 17, 2026

(54) VIBRATORY PILE DRIVING APPARATUS

(71) Applicant: DIESEKO GROUP B.V., Sliedrecht (NL)

(72) Inventors: Dirk Smulders, Sliedrecht (NL); Timo Olivier Van Dongen, Sliedrecht (NL)

(73) Assignee: DIESEKO GROUP B.V., Sliedrecht (NL)

( * ) Notice: Subject to any disclaimer, the term of this patent is extended or adjusted under 35 U.S.C. 154(b) by 76 days.

(21) Appl. No.: 18/726,946

(22) PCT Filed: Jan. 4, 2023

(86) PCT No.: PCT/EP2023/050118
§ 371 (c)(1),
(2) Date: Jul. 5, 2024

(87) PCT Pub. No.: WO2023/131623
PCT Pub. Date: Jul. 13, 2023

(65) Prior Publication Data

US 2025/0154739 A1 May 15, 2025

(30) Foreign Application Priority Data

Jan. 6, 2022 (NL) ..... 2030443

(51) Int. Cl.
*E02D 11/00* (2006.01)
*E02D 7/18* (2006.01)
(Continued)

(52) U.S. Cl.
CPC ..... *E02D 11/00* (2013.01); *E02D 7/18* (2013.01); *E02D 9/02* (2013.01); *E02D 13/00* (2013.01)

(58) Field of Classification Search
CPC .. E02D 11/00; E02D 7/18; E02D 9/02; E02D 13/00
See application file for complete search history.

(56) References Cited

U.S. PATENT DOCUMENTS 4,143,719 A * 3/1979 Furukawa ..... E02D 7/18 173/101
10,011,970 B2 * 7/2018 DeNeef ..... E02D 7/18
(Continued)

FOREIGN PATENT DOCUMENTS

EP 2597204 A1 5/2013
WO 2013051929 A1 4/2013
WO 2016130097 A1 8/2016

*Primary Examiner* — Janine M Kreck
(74) *Attorney, Agent, or Firm* — FisherBroyles, LLP; Roger L. Browdy

(57) ABSTRACT

The present invention relates to a vibratory pile driving apparatus for upending a pile and for driving a pile into the ground and/or extracting a pile out of the ground. The apparatus comprises a frame element, a clamping device, attached to the frame element at a first side thereof and configured to clamp the pile, at least one vibrator device, attached to the frame element at a second side, opposite to the first side, and configured to subject the frame element and the clamping device to a vibratory load, and a lifting yoke, rotatably connected to the frame element. The pile driving apparatus is configured to be suspended from a crane by the lifting yoke during use and the lifting yoke is configured to be rotated relative to the frame element to move the pile driving apparatus between a loading configuration and a pile driving configuration. The lifting yoke comprises one or more dampening elements, which are, during use, configured to deform to inhibit transmission of vibrations to the crane.

18 Claims, 10 Drawing Sheets

(51) Int. Cl.
*E02D 9/02* (2006.01)
*E02D 13/00* (2006.01)

(56) References Cited

U.S. PATENT DOCUMENTS

| | | | | |
|---|---|---|---|---|
| 2001/0002230 | A1* | 5/2001 | White | E02D 11/00 405/232 |
| 2017/0145650 | A1 | 5/2017 | Deneef et al. | |
| 2025/0092629 | A1* | 3/2025 | White | E02D 11/00 |

* cited by examiner

VIBRATORY PILE DRIVING APPARATUS

FIELD OF THE INVENTION

The present invention relates to a vibratory pile driving apparatus for upending a pile and for driving a pile into the ground and/or extracting a pile out of the ground. The present invention further relates to a method of driving a pile into the ground by means of such a vibratory pile driving apparatus and to a method of extracting a pile out of the ground by means of such a vibratory pile driving apparatus.

STATE OF THE ART

At present, various types of vibratory pile driving apparatuses are known. These apparatuses are configured to clamp a pile, such as a monopile or a sheet pile, and are configured to exert vibrations onto the pile with a vibrator device, to drive the pile into the ground. Similarly, piles can be extracted out of the ground by exerting vibrations on the pile and by pulling the pile upwards with the pile driving apparatus. With the term ground, it is meant that the pile can be inserted on land or offshore, for example on the sea bed.

The piles that are to be inserted in the ground are typically supplied in a horizontal orientation, which means that they need to be upended prior to insertion in a substantially vertical direction. In the past, combined pile driving apparatuses have been developed, which are both able to upend a pile and to drive a pile into the ground. An example of such an apparatus is disclosed in European patent EP 2 764 163 B1.

This patent discloses a vibratory pile driving apparatus that is rotatable relative to a yoke between a loading position and a pile driving position, wherein the apparatus is configured to upend a pile upon moving from the loading position to the pile driving position. This movement between configurations is carried out by means a rope and cable system.

This known apparatus has the drawback that the yoke is connected to the pile indirectly, via the vibrator device, which implies that resilient dampening elements in the vibrator device, which otherwise serve the purpose of inhibiting vibrations towards a crane from which the pile driving apparatus is suspended, are loaded in an unfavourable direction during upending.

From European patent EP 3 155 176 B1, a solution to this unfavourable loading of the resilient elements is proposed, in which a bias is applied to the resilient dampening elements during upending. The bias is configured to form a rigid coupling, to temporarily bridge the resilient elements during upending.

This latter pile driving apparatus has the drawback that the bridging of the resilient elements is relatively complex and that the loads that need to be transmitted are relatively high. Furthermore, the bias applied to the resilient elements still differs from normal loads to which the apparatus is subjected during driving or extracting of the pile, which means that damaging of the resilient dampening elements may still not be avoided fully.

OBJECT OF THE INVENTION

It is therefore an object of the invention to provide a vibratory pile driving apparatus that is able to upend a pile and to drive a pile into the ground and/or to extract a pile out of the ground without damaging resilient dampening elements, or at least to provide an alternative vibratory pile driving apparatus.

DETAILED DESCRIPTION

The present invention provides a vibratory pile driving apparatus for upending a pile and for driving a pile into the ground and/or extracting a pile out of the ground, the apparatus comprising:

- a frame element,
- a clamping device, attached to the frame element at a first side thereof and configured to clamp the pile,
- at least one vibrator device, attached to the frame element at a second side, opposite to the first side, and configured to subject the frame element and the clamping device to a vibratory load, and
- a lifting yoke, rotatably connected to the frame element,
- wherein the pile driving apparatus is configured to be suspended from a crane by the lifting yoke during use, wherein the lifting yoke is configured to be rotated relative to the frame element to move the pile driving apparatus between a loading configuration and a pile driving configuration, and wherein the lifting yoke comprises one or more dampening elements, which are, during use, configured to deform to inhibit transmission of vibrations to the crane.

According to the present invention, the vibratory pile driving apparatus comprises a frame element, onto which other components, such as the clamping device and the at least one vibrator device, are attached. Preferably, these components are attached in a modular manner, so that the maximum exerted vibration energy can be adjusted and that the pile driving apparatus can be accommodated to piles of various sizes, e.g. diameters.

The frame element has a first side and a second side, which are located opposite to each other. In the pile driving configuration, the frame element may be aligned substantially horizontally, so that the first side may be formed by a bottom surface of the frame element and that the second side may be formed by a top surface of the frame element. Accordingly, the frame element may be aligned in a plane parallel to a vertical direction in the loading configuration, so that, for example, the first side of the frame element may face to the left and that the second side of the frame element may face to the right.

The clamping device is provided at the first side and may comprise one or more clamps, for example one or more hydraulic clamps. The number of clamps may vary, depending on the application. If, for example, the pile driving apparatus is intended for driving sheet piles, a single clamp may suffice for reliably clamping the pile. However, in case tubular monopiles are to be driven in the ground, the clamping device may comprise multiple clamps, which are spread relative to each other.

In the loading configuration, the clamping device may point to the side. As such, the clamping device is connectable to a head end of a pile that is in a horizontal configuration. This connection can be established by clamping of the pile with the clamping device, for example at a number of points around the perimeter of the pile. In the pile driving configuration, the pile becomes aligned parallel to the vertical direction and the first side of the frame element with the clamping device will end up facing down.

The present pile driving apparatus has the benefit that the upending of the pile and the insertion in the ground is done with the same apparatus, being suspended from a single crane. It is therefore not needed to provide dedicated handling and upending equipment, nor is it necessary to have a separate crane for lifting and upending and a second crane for supporting the pile driving apparatus.

The at least one vibrator device may comprise a single vibrator device or a plurality of vibrator devices, in case it is desired to subject the pile to a relatively large vibratory load. The vibrator device may be hydraulic vibrator device, comprising a hydraulic motor that is configured to drive one or more eccentric weights in rotation to obtain an oscillatory vibrational load.

The at least one vibrator device is attached to the frame element, which implies that the vibrator device is configured to exert the vibrational load on the frame element. In turn, the vibrational load is transmitted on the pile, i.e. via the clamping device.

The at least one vibrator device is arranged at the second side of the frame element, opposite to the clamping device at the first side. In the pile driving configuration, the at least one vibrator device is thus arranged on top of the frame element.

The lifting yoke of the pile driving apparatus is rotatably connected to the frame element and is configured to support the weight of the pile driving apparatus when the pile driving apparatus is suspended from a crane. The lifting yoke may thereto comprise one or more lifting trunnions, which are, during use, configured to receive a lifting cable that is attached to the crane.

The lifting yoke and the frame element are rotatable relative to each other during use of the pile driving apparatus for upending the pile. The lifting yoke thereby remains substantially stationary, for example aligned in the vertical direction, i.e. being suspended from the crane, and the frame element, including the clamping device and the at least one vibrator device, is rotated. The stationary orientation of the lifting yoke during movement of the pile driving apparatus between the loading orientation and the pile driving configuration implies that the mechanical loads transmitted by the lifting yoke, i.e. from the frame element towards the crane, remain substantially constant. The upending loads in the lifting yoke may thus be substantially independent of the configuration of the pile driving apparatus.

The lifting yoke is attached to the frame element directly, for example by means of a hinge device of the frame element. This implies that the lifting yoke is not directly coupled to the vibrator device, but rather indirectly, via the frame element. The lifting yoke is in particular attached to a dynamic part of the pile driving apparatus, i.e. a part of the pile driving apparatus that is subjected to vibrational loads during use of the apparatus for driving or extracting piles.

The present pile driving apparatus thereby differs from many known pile driving apparatuses, including the apparatuses known from the prior art documents cited above. Hence, in those apparatuses, the crane was configured to carry the pile driving apparatus with a yoke attached to a static part that was vibrationally isolated from the dynamic part, for example by means of resilient dampening elements in the vibrator devices themselves.

In the prior art, mechanical loads occurring during upending were transmitted from the pile to the crane in series, namely via the clamping device, the vibrator device and the lifting yoke. Here, the mechanical loads were also transmitted via resilient dampening elements in the vibrator devices, resulting in the unfavourable loading thereof.

According to the present invention, the mechanical loads during upending can be regarded to bypass the at least one vibrator device. Hence, they are transmitted via the clamping device, the frame element and the lifting yoke. The upending loads are not transmitted via the at least one vibrator device, which means that the present pile driving apparatus does not suffer from the undesirable loading of resilient dampening elements in the vibrator devices.

In particular, the at least one vibrator device in the pile driving apparatus according to the present invention may be free of any resilient dampening element, because the at least one vibrator device does not serve a purpose of supporting the pile and the pile driving apparatus.

As a result of the lifting yoke comprising both a static part and a dynamic part, it may still be desired to inhibit transmission of vibrations from the dynamic part towards the crane. During driving of a pile, this may be done by letting the pile driving apparatus rest on the pile and releasing tension on lifting cables, so that they cannot transmit vibrations. However, it is also intended to extract piles from the ground, which requires an upward vertical force to be applied by the crane, thus requiring tensioning of the lifting cables.

To this effect, the lifting yoke of the present pile driving apparatus comprises one or more resilient dampening elements. These dampening elements are configured to inhibit transmission of vibrations to the crane, which means that the crane can apply the upward vertical force for extracting the pile, without being subjected to the vibrations.

It was explained above that the upending loads in the lifting yoke, in particular the direction in which they occur, remain substantially constant during upending. It was found by the present inventors that the one or more dampening elements in the pile driving apparatus are loaded substantially constant, i.e. in substantially the same direction, as well during upending and during vibrating in the pile driving position. In particular, the loading direction of the one or more dampening elements may remain constant in all configurations.

Accordingly, the one or more dampening elements are only loaded in a favourable direction, irrespective of a relative position between the lifting yoke and the frame element during upending. As a result, the dampening elements may not need to be loaded unfavourably during upending, thereby enabling an increase in lifetime of the pile driving apparatus.

The present pile driving apparatus thus forms a favourable improvement relative to existing pile driving apparatuses, in particular enabling upending of piles and enabling driving and extracting of the piles, without damaging dampening elements of the pile driving apparatus.

In an embodiment of the vibratory pile driving apparatus, the one or more dampening elements are configured to deform in a substantially vertical direction during use.

According to this embodiment, the lifting yoke remains in a substantially vertical orientation during upending and during vibrating. Both in the loading configuration and the pile driving configuration, and in all relative positions of the lifting yoke between these configurations, the lifting yoke remains orientated vertically.

As a result, the loading of the lifting yoke during upending and during applying the vibrations is directed in the vertical direction, irrespective of the configuration of the lifting yoke relative to the frame element. This implies that the dampening elements are loaded in the vertical direction in all configurations and that deformations of the dampening elements also only occur in the vertical direction.

The dampening elements are positioned to be able to accommodate deformations in the vertical direction, to be able to dampen vibrations from the at least one vibrator device in the vertical direction. As a result, the dampening elements may not be subjected to deformations other than in the vertical direction, thereby avoiding undesired damaging of the dampening elements.

In an embodiment of the vibratory pile driving apparatus, the lifting yoke further comprises:

- a dynamic part, which is attached to the frame element, and
- a static part, with which the pile driving apparatus is configured to be suspended from the crane, wherein the one or more dampening elements are functionally arranged in between the dynamic part and the static part, to inhibit transmission of vibrations from the dynamic part to the static part.

The lifting yoke is configured to inhibit transmission of vibrations by dampening relative movements between the dynamic part of the lifting yoke and the static part thereof. The dynamic part is attached to the frame element and is thus subject to the vibrations that are exerted on the pile, via the frame element. Meanwhile, the stationary part of the lifting yoke is intended to be attached to a crane and is thus desired to be substantially free of vibrations.

The dampening elements are arranged in between the dynamic part and the static part, which has the benefit that the mechanical loads from the crane to the frame element and vice versa are transmitted via the dampening elements. This implies that the dampening elements are subjected to mechanical loads both during upending and during vibrating, but that these loads are always in favourable directions, to prevent damaging of the dampening elements.

In a further embodiment of the vibratory pile driving apparatus, the static part comprises a downward yoke arm, extending in a downward vertical direction, the dynamic part comprises an upward yoke arm extending in a downward vertical direction, the downward yoke arm and the upward yoke arm at least partially face each other to form a set of yoke arms, and the one or more dampening elements are attached in between the downward yoke arm and the upward yoke arm.

The static part of the lifting yoke may comprise a single downward yoke arm or may comprise multiple downward yoke arms. Similarly, the dynamic part of the lifting yoke may comprise a single upward yoke arm or may comprise multiple upward yoke arms.

The downward yoke arms and the upward yoke arms extend in opposite directions, for example respectively having a free lower end and a free upper end. The downward yoke arm may be configured to be suspended from a crane at an upper side and the upward yoke arm may be rotatably connected to the frame element at a lower end.

The downward yoke arm and the upward yoke arm face each other, i.e. to overlap with each other partly in a vertical plane. Part of the downward yoke arm thus lies directly opposite to part of the upward yoke arm, seen in a vertical plane. Hence, the upward yoke arms and the downward yoke arms may extend in planes that are parallel to each other. The one or more dampening elements are attached in between these overlapping parts.

The lifting yoke may be loaded in a substantially vertical direction, which means that the vibrations and loading during upending results in mutual vertical displacements between the downward yoke arms and the upward yoke arms. Accordingly, the dampening elements in between the downward yoke arms and the upward yoke arms are subjected to shear forces and are configured to accommodate mutual shear strains between the downward yoke arms and the upward yoke arms. The dampening elements may be selected or designed to be able to accommodate such shear strains, to prevent damaging of the dampening elements.

In case only a single dampening element is provided in between each set of yoke arms, all loads between these yoke arms are transmitted via this single dampening element. If, however, multiple dampening elements are provided per set of yoke arms, the dampening elements may be provided above each other in between the yoke arms or next to each other. The dampening elements may thereby be loaded in parallel, so that relatively large mechanical loads can be transmitted between the static part and the dynamic part of the lifting yoke.

In a further embodiment of the vibratory pile driving apparatus, each set of yoke arms comprises at least two downward yoke arms, wherein the upward yoke arm is arranged centrally in between the downward yoke arms and wherein the lifting yoke comprises at least one respective dampening element in between the central upward yoke arm and each of the downward yoke arms. Alternatively or additionally according to this embodiment of the vibratory pile driving apparatus, each set of yoke arms comprises at least two upward yoke arms, wherein the downward yoke arm is arranged centrally in between the upward yoke arms and wherein the lifting yoke comprises at least one respective dampening element in between the central downward yoke arm and each of the upward yoke arms.

According to this embodiment, each set of yoke arms may comprise more than a single downward yoke arm and/or more than a single upward yoke arm. The multiple downward yoke arms or multiple upward yoke arms are aligned parallel to each other and are spaced at a distance from each other. In the spacing between the downward yoke arms or between the upward yoke arms, the upward yoke arm or the downward yoke arms may be provided, respectively.

As such, the central upward yoke arm is arranged in between outer downward yoke arms and/or the central downward yoke is arranged in between outer upward yoke arms. The central one of the yoke arms faces a respective outer yoke arm on both its opposite sides, and accordingly comprises one or more dampening elements on both its opposite sides, each extending towards a respective outer yoke arm.

This embodiment of the vibratory pile driving apparatus may offer symmetric loading of the sets of yoke arms, having a central downward yoke arm in between two outer upward yoke arms and/or having a central upward yoke arm in between two outer downward yoke arms. The dampening elements at the opposite sides of the central yoke arm are loaded in parallel to each other as well, to further increase the loads that can be transmitted between the static part and the dynamic part of the lifting yoke.

In a further or alternative embodiment of the vibratory pile driving apparatus, the static part further comprises a spreader bar, extending in a horizontal direction parallel to an axis of rotation between the lifting yoke and the frame element, wherein opposed sideward sets of yoke arms are provided at opposite ends of the spreader bar, formed by the downward yoke arms that downwardly extend from the spreader bar and by the upward yoke arms that are arranged at opposite sides of the frame element.

The spreader bar is configured to be suspended from the crane and horizontally spans above the frame element, having a width substantially corresponding to a width of the frame element. The spreader bar extends parallel to the axis of rotation of the lifting yoke, so that the spreader bar remains in its stationary horizontal orientation, irrespective of the rotation of the frame element underneath it.

The lifting yoke comprises a set of yoke arms at its opposite ends, so that the lifting yoke is attached to the frame element at opposite sides thereof. As such, the stability of the connection between the lifting yoke and the frame element is relatively high and a central space is defined between the sets of yoke arms, in which, for example, the one or more vibrator devices may be arranged.

According to this embodiment, the lifting yoke comprises two sets of yoke arms, each having its own dampening elements. Preferably, each set of yoke arms comprises at least one central yoke arm and at least two outer yoke arms, therefor each comprising a respective set of dampening elements at the opposite sides of the central yoke arm.

In a further embodiment of the vibratory pile driving apparatus, the lifting yoke further comprises a central set of downward yoke arms and upward yoke arms, which is located centrally in between the opposed sideward sets of yoke arms.

The central set of yoke arms may be provided to increase the mechanical loads that can be transmitted between the frame element and the crane. The central set of yoke arms may also comprise at least one central yoke arm and at least two outer yoke arms, to have dampening elements on opposite sides of the central yoke arm.

With the central set of yoke arms being present, the space between the sideward sets of yoke arms is subdivided in two space parts. Each of these space parts may comprise an equal number of vibrator devices, to obtain a substantially symmetrical vibratory pile driving apparatus.

Preferably, the central set of yoke arms comprises three downward yoke arms that are spaced at a distance from each other, defining two spacings in between them. Accordingly, the central set of yoke arms may comprise two upward yoke arms, each projecting in a respective spacing between the downward yoke arms. As such, a total of four dampening elements may be provided side by side between the yoke arms of the central set of yoke arms. Alternatively, the central set of yoke arms may comprise three upward yoke arms and two downward yoke arms.

In an embodiment of the vibratory pile driving apparatus, the one or more dampening elements are made of an elastomeric material, for example made of a rubber material, such as a synthetic rubber material.

The elastomeric material has resilient properties, being able to deform elastically when loaded. As a result, the deformations of the elastomeric material may be used to compensate for mutual displacements within the lifting yoke, i.e. between the dynamic part and the static part, thereby allowing for inhibition of vibrations by the lifting yoke.

It was found that a rubber material, especially synthetic rubber material, is able to offer desired dampening properties, whilst still offering a strength sufficient for use in a vibratory pile driving apparatus.

In an embodiment of the vibratory pile driving apparatus, the one or more dampening elements are modular dampening cassettes, comprising a changeable number of dampers, which are deformable in parallel to each other.

Each of the dampening elements is thereby embodied as dampening cassette, comprising a number of dampers that corresponds to a height or width of the overlap between the upward yoke arm and the downward yoke arm that face each other. In case the yoke arms overlap over a relatively large distance, the dampening cassettes may each comprise a relatively large number of dampers. However, when the yoke arms only overlap over a small distance, the dampening cassettes may be relatively small, comprising a relatively small number of dampers.

A single dampening cassette may be provided between each opposed downward yoke arm and upward yoke arm. If, for example, a set of yoke arms comprises a single upward yoke arm in between two downward yoke arms, this set may comprise two dampening cassettes, i.e. one at each side of the upward yoke arm. If, on the other hand, a set of yoke arms comprises two upward yoke arms in between three downward yoke arms, this set may comprise four dampening cassettes, i.e. one at each side of both upward yoke arms.

In an embodiment, the vibratory pile driving apparatus further comprises a relaxation device, which is configured to deform one or more of the dampening elements towards a neutral configuration. The deforming of the dampening elements may compensate for any plastic deformation in the dampening elements following the use of the vibratory pile driving apparatus. Hence, during use, the dampening elements may plastically deform under influence of mechanical loads. The compensation with the relaxation device may allow for convenient disassembly of the dampening elements, for example when it is desired to replace dampening elements in an existing vibratory pile driving apparatus.

In an embodiment of the vibratory pile driving apparatus, the frame element further comprises at least one hinge device and the lifting yoke is attached to the frame element by means of the at least one hinge device.

The hinge device may be configured to effect the mutual rotation between the lifting yoke and the frame element, upon changing from the loading configuration of the vibratory pile driving apparatus to the pile driving configuration and vice versa. A single hinge device may be provided for each of the respective sets of yoke arms.

The hinge devices may each comprise a hinge pin extending through holes in the upward yoke arms of the lifting yoke. The upward yoke arms thereby project away from the frame element and are rotatable relative to the frame element upon rotation about the hinge pins.

In a further embodiment of the vibratory pile driving apparatus, the downward yoke arms project towards the hinge devices and each comprise a slotted hole that is substantially elongate in the vertical direction. The hinge pins further project through the slotted holes in the downward yoke arms, but do not contact the downward yoke arms during normal use of the vibratory pile driving apparatus, i.e. during upending and during vibrating.

However, the slotted holes are beneficial in case of failure of one or more of the dampening elements. Hence, this could cause the normal connection between the upward yoke arms and downward yoke arms via the dampening elements to break, resulting in a drop of the frame element relative to the lifting yoke. According to this embodiment, the hinge pin may then become supported in the slotted hole of the downward yoke arm, which thus offers an emergency support.

In an embodiment, the vibratory pile driving apparatus further comprises an actuator, for example a hydraulic actuator, which is attached to the frame element and the lifting yoke and which is configured to move the lifting yoke relative to the frame element between the loading configuration and the pile driving configuration.

The actuator may be embodied as a hydraulic cylinder and is configured to effect a mutual displacement between parts of the frame element and parts of the lifting yoke, so that the mutual rotation between the frame element and the lifting yoke can be established, to move the vibratory pile driving apparatus between the loading configuration and the pile driving configuration.

Preferably, the axis of rotation coincides with the combined centre of gravity of the frame element and the at least one vibrator device. This may reduce the effort needed to rotate the frame element and the at least one vibrator device relative to the lifting yoke, thereby lowering the requirements for the actuator.

In an embodiment of the vibratory pile driving apparatus, the lifting yoke further comprises a cable guiding device, configured to guide cables and/or hydraulic fluid lines departing from the pile driving apparatus.

The cable guiding device is attached to the lifting yoke and is thus configured to remain substantially stationary as well, irrespective of a mutual position between the lifting yoke and the frame element. The cable guiding device is thereby able to reliably guide the cables, since the guiding of the cables will not be disturbed by changes in mutual orientation between the lifting yoke and the frame element.

Preferably, the cable guiding device extends substantially horizontally away from the lifting yoke, in a horizontal direction substantially perpendicular to the axis of rotation. In the loading configuration of the vibratory pile driving apparatus, the cable guiding device faces the second side of the frame element, which implies that the cables and hydraulic fluid lines are guided away from the vibratory pile driving apparatus in a direction away from the pile that is clamped, thereby avoiding entanglement of the cables and hydraulic fluid lines with the pile.

In an embodiment of the vibratory pile driving apparatus, the frame element comprises a plurality of clamp mounting rails at its first side, the clamp mounting rails extend in a radial direction relative to the vertical direction, i.e. in the pile driving configuration, wherein the clamping device comprise two or more clamps, for example hydraulic clamps, which are attached to the clamp mounting rails to define a pile clamping pattern, for example a circular pile clamping pattern, between them, and wherein the clamps are slidable along the clamp mounting rails to adjust a dimension, for example a diameter, of the pile clamping pattern.

According to this embodiment, the vibratory pile driving apparatus is suited to insert or extract monopiles having an annular, for example circular cross-section. The clamps are thereby configured to grip an upper edge of the pile for upending and during the vibrating.

The clamps are arranged in a pile clamping pattern, which have a shape that corresponds to the upper edge of the pile that is to be gripped. The clamps are for example arranged in a circular clamping pattern having a diameter that corresponds to the diameter of the pile.

The present vibratory pile driving apparatus can be adjusted for various different types of piles, having different diameters, by sliding the clamps along the clamp mounting rails that are provided at the first, e.g. bottom side of the frame element.

The diameter of the pile clamping pattern can be increased by moving the clamps in a radially outward direction, to be able to clamp a pile with a relatively large diameter. Similarly, the diameter of the pile clamping pattern can be reduced by moving the clamps in a radially inward direction, to be able to clamp a pile with a relatively small diameter.

Furthermore, the clamps may be arranged in a noncircular pile clamping pattern, for example in an ellipsoid pile clamping pattern. As such, the vibratory pile driving apparatus can compensate for any out of roundness of the piles, for example in case the piles have a dent or the like at their top contour.

In an embodiment of the vibratory pile driving apparatus, the frame element comprises one or more vibrator mounting rails at its second side, and the at least one vibrator device is attached to the vibrator mounting rails.

The vibrator mounting rails are fixedly attached to the frame element, in order to improve the transmission of vibrations, induced by the at least one vibrator device on the vibrator mounting rails, on the pile that is clamped by the clamping device at the second side of the frame element. The number of vibrator devices can be selected on the basis of the requirements for the magnitude of the vibrations to which the pile needs to be subjected.

Preferably, the vibrator devices are mounted on the vibrator mounting rails symmetrically with respect to the axis of rotation, i.e. seen in the pile driving configuration. This may contribute to an improved distribution of weight, so that the centre of gravity of the frame element with the clamping device and all vibrator devices horizontally coincides with the lifting yoke. As such, the weight of the vibratory pile driving apparatus acting on the pile may be distributed evenly during inserting of the pile. Furthermore, the loads acting on the crane during extracting of the pile, being exerted by the vibratory pile driving apparatus and the pile, may be evenly distributed as well.

In a further embodiment of the vibratory pile driving apparatus, the vibrator mounting rails extend in a horizontal direction perpendicular to the axis of rotation, i.e. in the pile driving configuration, and the at least one vibrator device is, at least in the loading configuration, arranged in between the opposed sets of yoke arms of the lifting yoke.

The vibrator mounting rails according to this embodiment may extend in a direction perpendicular to the axis of rotation, so that the vibrator mounting rails extend in a horizontal direction in the pile driving configuration and that they extend in a vertical direction in the loading configuration.

The vibrator mounting rails are provided in between the sets of yoke arms, for example in between the opposed sideward sets of yoke arms or on opposite sides of a central set of yoke arms. This placement of the vibrator devices allows that rotation of the frame element relative to the lifting yoke is not obstructed by the vibrator devices colliding with the lifting yoke.

In an embodiment, the vibratory pile driving apparatus comprising one or more primary lifting lines, for example cables or chains, which are attached to the lifting yoke and which are configured to be attached to a crane for suspending the vibratory pile driving apparatus.

This vibratory pile driving apparatus may further comprise a lifting corrector arm, which is attached to the lifting yoke and which is movable relative to the lifting yoke between an inner position and an outer position. The vibratory pile driving apparatus may then further comprise one or more auxiliary lifting lines, which are attached to the lifting corrector arm and which are configured to be attached to the crane as well.

The lifting corrector arm and the auxiliary lifting lines are together configured to shift a suspension point of the vibratory pile driving apparatus relative to the centre of gravity of the vibratory pile driving apparatus.

In the inner position of the lifting corrector arm, the entire weight of the vibratory pile driving apparatus may be suspended by the primary lifting lines. During use, the suspension point of the vibratory pile driving apparatus, i.e.

the point where the lifting lines are attached to the crane, may be aligned vertically above the centre of gravity of the vibratory pile driving apparatus in the inner position of the lifting corrector arm.

In the outer position of the lifting corrector arm, the auxiliary lifting lines are tensioned and at least part of the weight of the vibratory pile driving apparatus becomes suspended by the auxiliary lifting lines. In this configuration, at least one of the primary lifting lines becomes relaxed.

Due to the outward movement of the lifting corrector arm towards the outer position, the suspension point of the vibratory pile driving apparatus is shifted relative to the centre of gravity of the vibratory pile driving apparatus, to adjust the stability of the vibratory pile driving apparatus.

This shifting of the suspension point may be beneficial to compensate for tilting moment exerted by the cable guiding device and by cables and/or hydraulic fluid lines departing from the pile driving apparatus at the cable guiding device. For example, the tilting of the lifting corrector arm, i.e. in the loading configuration of the vibratory pile driving apparatus, may influence the orientation of the clamping device at the first side of the frame element to correspond to the orientation of the pile that is to be clamped.

The present invention further provides a method of driving a pile into the ground by means of the vibratory pile driving apparatus as disclosed herein, preferably as recited in any of the claims 1-15, wherein the method comprises the steps of:

clamping the pile by means of the clamping device,
moving the pile to a location where it is to be driven in the ground, and
subjecting the pile to vibrations with the at least one vibrator device.

The insertion method according to the present invention may comprise one or more of the features and/or benefits disclosed herein in relation to the vibratory pile driving apparatus according to the present invention. According to the present method, a pile is inserted in the ground by subjecting the pile to vibrations with the vibratory pile driving apparatus. The pile not needs to be provided in a horizontal orientation, but may also be provided in a vertical orientation or any orientation in between.

As a first step, the pile is clamped by means of the clamping device. The clamping may be carried out with the vibratory pile driving apparatus in a loading configuration, in case the pile is provided in a horizontal orientation, or in a pile driving configuration, in case the pile is already provided in the vertical orientation.

Next, the pile is moved towards the location where it is to be driven into the ground. This movement is carried by means of a crane, from which the vibratory pile driving apparatus is suspended. The pile is thereby suspended from the vibratory pile driving apparatus.

Finally, the pile is arranged on a ground surface, for example on the bottom of a sea or lake, and is then subjected to vibrations. Meanwhile, the vibratory pile driving apparatus can be lowered, so that the weight of the vibratory pile driving apparatus rests on the pile to further promote insertion in the ground during vibrating.

According to the present method, mechanical loads from the crane towards the pile during inserting can be regarded to bypass the at least one vibrator device. Hence, they are transmitted via the clamping device, the frame element and the lifting yoke and are not transmitted via the at least one vibrator device. As such, it may be provided that transmission of vibrations towards the crane is inhibited.

In a further embodiment of the method, the step of clamping is carried out with the pile driving apparatus in the loading configuration, the method further comprises the step of upending of the pile from a substantially horizontal orientation into a substantially vertical orientation, prior to driving it into the ground, wherein the step of upending comprising lifting the pile driving apparatus and the pile and rotating the pile driving apparatus towards the pile driving configuration during the lifting, to bring the pile from the substantially horizontal orientation into the substantially vertical.

According to this embodiment of the method, the pile is initially provided in a horizontal orientation and is upended prior to insertion in the ground. During clamping, the vibratory pile driving apparatus is in its loading configuration, in which the clamping devices face towards the side, in order to clamp an upper edge of the horizontal pile.

The present embodiment of the method may thereto optionally comprise the step of moving the vibratory pile driving apparatus from the pile driving configuration into the loading configuration, prior to the step of clamping the pile.

During the upending, the vibratory pile driving apparatus is lifted and the pile is lifted at least partly in accordance. In this manner, the clamped end of the pile is lifted, while an opposed end of the pile may remain resting on the ground. During the lifting, the vibratory pile driving apparatus is allowed to move from its loading configuration into the pile driving configuration, so that the clamping device comes to face in a vertically downward direction. In accordance, the pile is gradually transferred into a vertical orientation as a result of the change in configuration of the vibratory pile driving apparatus.

During the upending, the vibratory pile driving apparatus is suspended from a crane, which crane is configured to apply an upward force on the vibratory pile driving apparatus, and thus indirectly on the pile.

According to the present embodiment of the method, the mechanical loads during upending can be regarded to bypass the at least one vibrator device. Hence, they are transmitted via the clamping device, the frame element and the lifting yoke. The upending loads are not transmitted via the at least one vibrator device. As such, it may be prevented that dampening elements of the vibratory pile driving apparatus are loaded in unfavourable directions during upending, thereby reducing damaging of the dampening elements.

The present invention also provides a method of extracting a pile out of the ground by means of the vibratory pile driving apparatus as disclosed herein, preferably as recited in any of the claims 1-15, wherein the method comprises the steps of:

clamping the pile by means of the clamping device,
subjecting the pile to vibrations from the at least one vibrator device, and
pulling the pile in an upward vertical direction with the pile driving apparatus.

The extraction method according to the present invention may comprise one or more of the features and/or benefits disclosed herein in relation to the vibratory pile driving apparatus according to the present invention or in relation to the insertion method according to the present invention.

As a first step in the method, the pile is clamped by means of the clamping device. The clamping may be carried out with the vibratory pile driving apparatus in the pile driving configuration, because the pile may generally be provided in a vertical orientation. According to the present method, the piles that are to be extracted may also be aligned in a non-vertical direction initially, for example being inserted at a small angle relative to the vertical direction. In accordance, the clamping of the pile may be carried out by the vibratory pile driving apparatus in which the frame element is at a corresponding small angle relative to the lifting yoke, i.e. almost being arranged in the pile driving configuration.

During the extracting, the vibratory pile driving apparatus is suspended from a crane, which crane is configured to apply an upward force on the vibratory pile driving apparatus, and thus indirectly on the pile.

According to the present method, the mechanical pulling loads during extracting can be regarded to bypass the at least one vibrator device. Hence, they are transmitted via the clamping device, the frame element and the lifting yoke. The extracting loads are not transmitted via the at least one vibrator device. As such, it may be provided that transmission of vibrations towards the crane is inhibited, even with the upward vertical forces being applied by the crane.

BRIEF DESCRIPTION OF DRAWINGS

Further characteristics of the invention will be explained below, with reference to embodiments, which are displayed in the appended drawings, in which.

Throughout the figures, the same reference numerals are used to refer to corresponding components or to components that have a corresponding function.

DETAILED DESCRIPTION OF EMBODIMENTS

Figure 1:
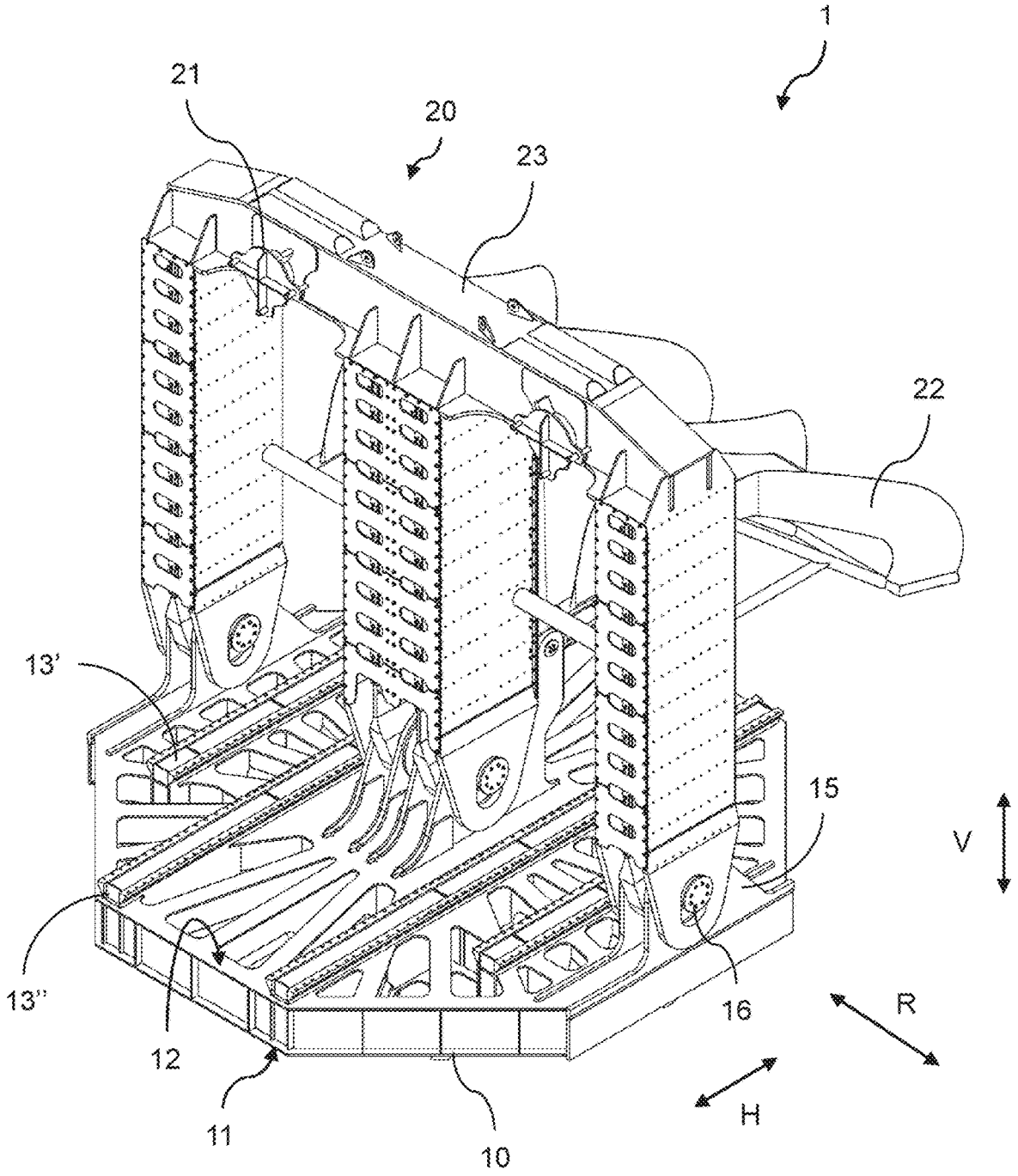
FIG. 1 schematically depicts an embodiment of the vibratory pile driving apparatus according to the present invention, arranged in the pile driving configuration.

FIG. 1 schematically depicts an embodiment of the vibratory pile driving apparatus according to the present invention, to which is referred with reference numeral 1. The vibratory pile driving apparatus 1 comprises a frame element 10, onto which other components, in particular a clamping device and vibrator device 30, are attached. The vibratory pile driving apparatus 1 further comprises a lifting yoke 20. For the sake of improving clarity of the drawings, the other components, such as vibrator devices are not visible in attached in FIGS. 1-4, but are displayed in FIG. 7.

The frame element 10 has a first side 11 and a second side 12, which are located opposite to each other. The lifting yoke 20 of the vibratory pile driving apparatus 1 is rotatably connected to the frame element 10 and is configured to support the weight of the vibratory pile driving apparatus 1 when the vibratory pile driving apparatus 1 is suspended from a crane. The lifting yoke 20 thereto comprises four lifting trunnions 21, which are, during use, configured to receive lifting cables that are attached to the crane.

The lifting yoke 20 and the frame element 10 are rotatable relative to each other during use of the pile driving apparatus 1 for upending the pile. This mutual rotation between the lifting yoke 20 and the frame element 10 is effected about a horizontal axis of rotation R, so that the pile driving apparatus 1 can be moved between a loading configuration and a pile driving configuration.

During this rotation, the lifting yoke 20 remains substantially stationary, for example aligned in a vertical direction V, as a result of being suspended from the crane. Meanwhile, the frame element 10 is rotated relative to the lifting yoke 20.

In FIG. 1, the vibratory pile driving apparatus 1 is shown in the pile driving configuration. The frame element 10 is thereby aligned substantially horizontally, so that the first side 10 is formed by a bottom surface of the frame element 10. The second side 12 is accordingly formed by a top surface of the frame element 10.

Figure 2:
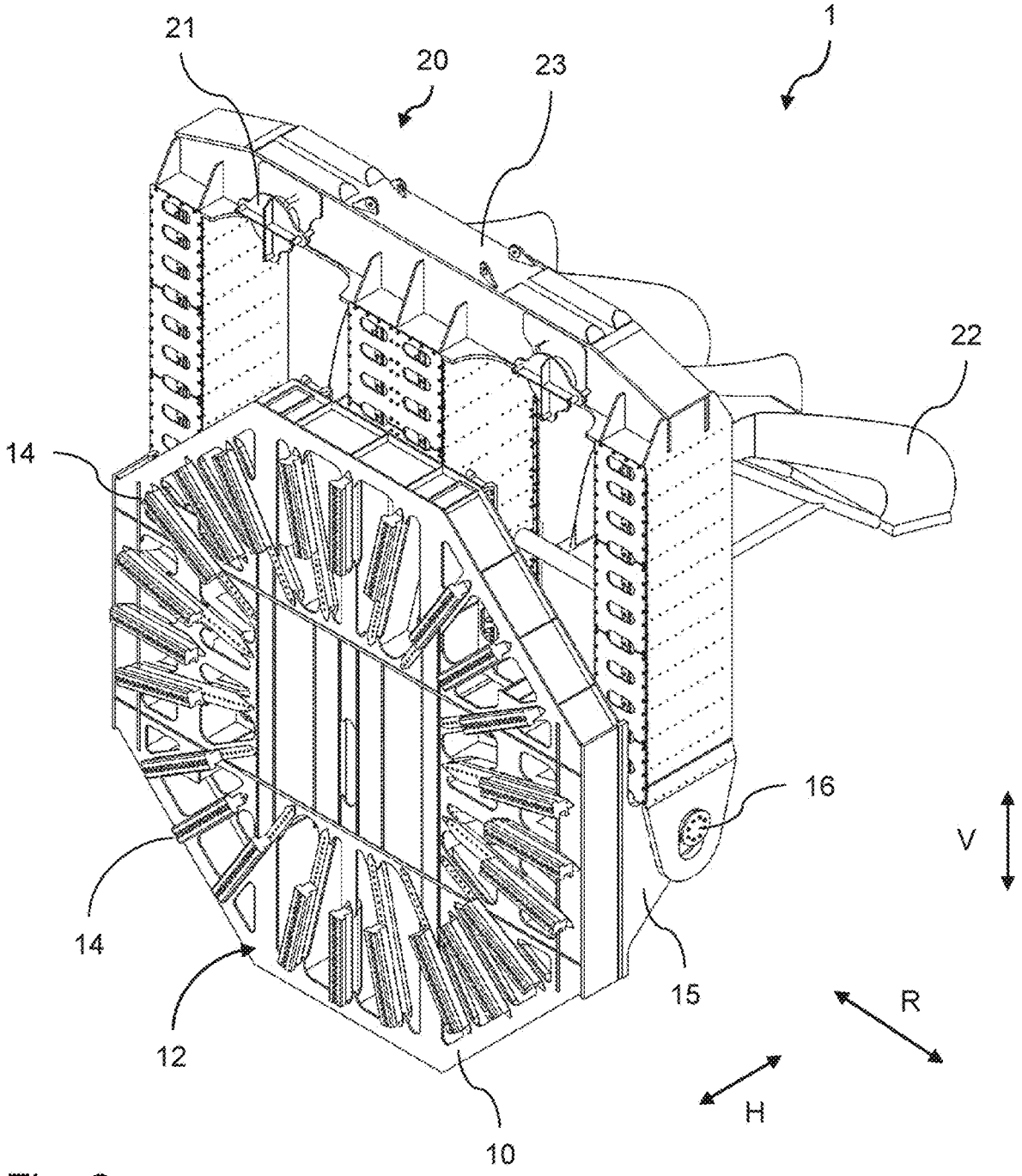
FIG. 2 depicts the vibratory pile driving apparatus of FIG. 1, arranged in the loading configuration.
Figure 3:
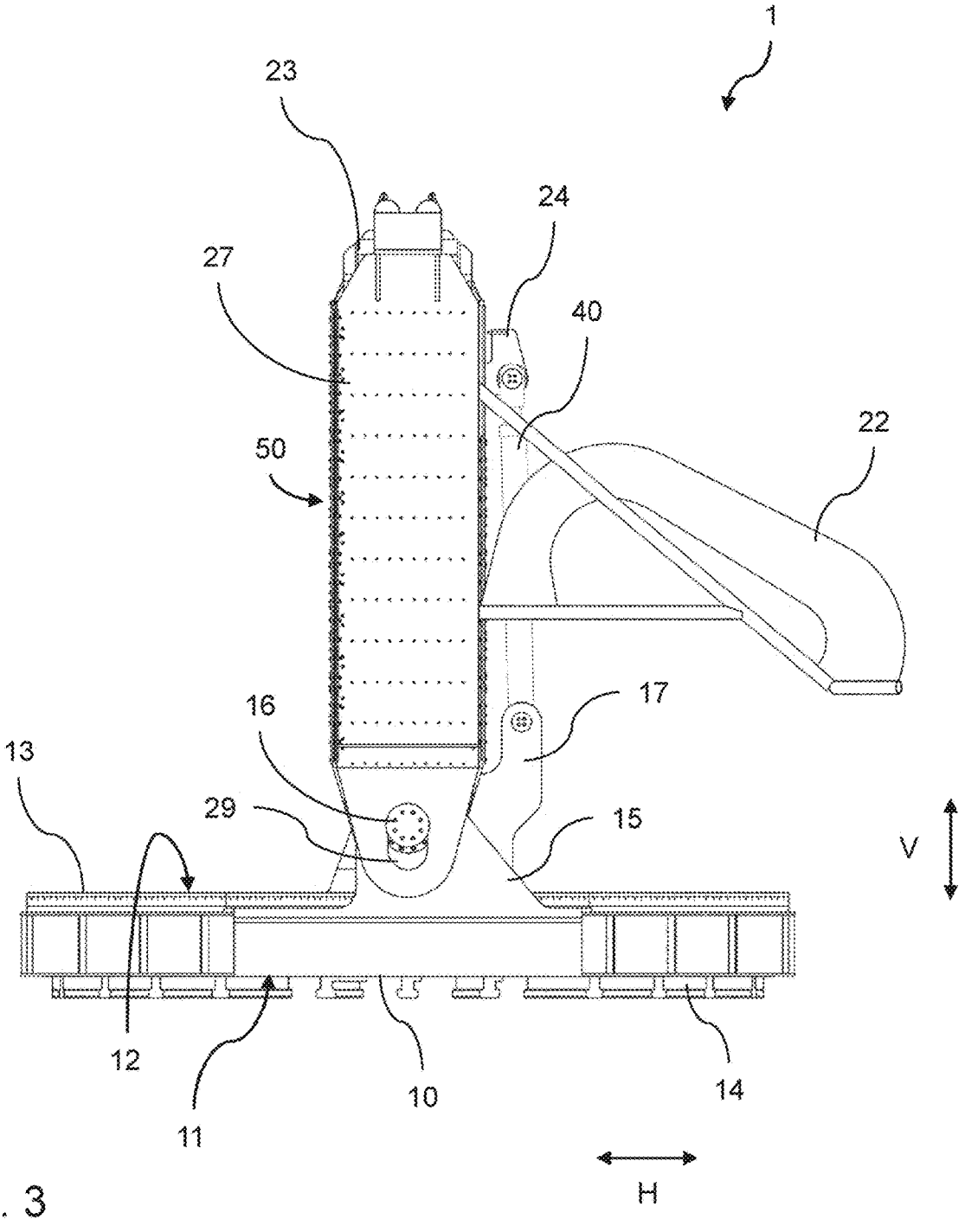
FIG. 3 depicts a side view on the vibratory pile driving apparatus of FIG. 1.

In FIG. 2, the vibratory pile driving apparatus 1 is shown in the loading configuration. In the loading configuration, the frame element 10 is aligned in a plane parallel to the vertical direction V, so that the first side 11 of the frame element 10 faces to the left and that the second side 12 of the frame element 10 faces to the right.

The stationary orientation of the lifting yoke 20 during movement of the pile driving apparatus 1 between the loading orientation and the pile driving configuration implies that the mechanical loads transmitted by the lifting yoke 20, i.e. from the frame element 10 towards the crane, remain substantially constant.

Figure 7:
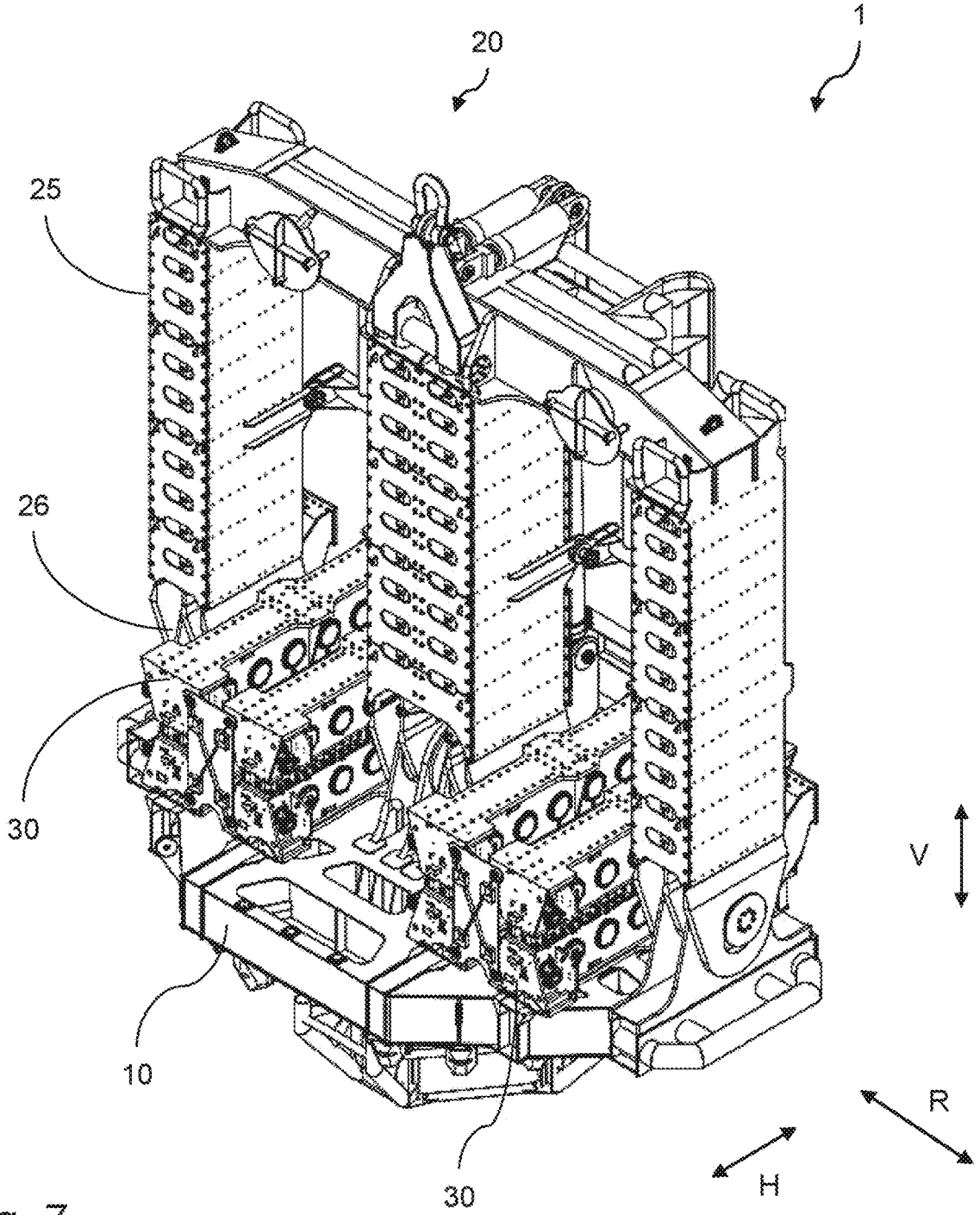
FIG. 7 depicts the embodiment of the vibratory pile driving apparatus, including other components, such as vibrator devices, FIGS. 8*a* and 8*b* schematically depict a further embodiment of the vibratory pile driving apparatus according to the present invention from the side.

The frame element 10 comprises four vibrator mounting rails 13 at its second side 12, which are each configured to receive at least one vibrator device 30. The vibrator devices 30 are configured to subject the pile to a vibratory load and thereto comprise a hydraulic motor that is configured to drive multiple eccentric weights in rotation to obtain an oscillatory vibrational load. In FIG. 7, the vibratory pile driving apparatus 1 is displayed with the vibrator devices 30 mounted thereon.

The vibrator devices 30 are configured to exert vibrational loads on the frame element 10, which are, in turn, transmitted on the pile via the clamping device. The vibrator mounting rails 13 are fixedly attached to the frame element 10, in order to improve the transmission of vibrations on the pile that is clamped by the clamping device at the second side 12 of the frame element 10.

The vibrator mounting rails 13 extend in a horizontal direction H perpendicular to the axis of rotation R. As such, the vibrator mounting rails 13 extend in the horizontal direction H in the pile driving configuration and extend in the vertical direction V in the loading configuration.

The number of vibrator devices 30 can be selected on the basis of the requirements for the magnitude of the vibrations to which the pile needs to be subjected. According to the present embodiment, the frame element 10 comprises two outer vibrator mounting rails 13' and two inner vibrator mounting rails 13".

The inner vibrator mounting rails 13" have a length that is relatively large compared to the length of the outer vibrator mounting rails 13'. Accordingly, the vibratory pile driving apparatus 1 comprises a total of six vibrator devices 30, as is shown in FIG. 7. Each of the inner vibrator mounting rails 13" is configured to receive two vibrator devices 30 and the outer vibrator mounting rails 13' are each configured to receive a single vibrator device 30.

The vibrator devices 30 are mounted on the vibrator mounting rails 13 symmetrically with respect to the axis of rotation R, i.e. seen in the pile driving configuration. This contributes to an improved distribution of weight, so that the centre of gravity of the frame element 10 with the clamping device and all vibrator devices 30 horizontally coincides with the lifting yoke 20, seen along the horizontal direction H.

The frame element 10 comprises a plurality of clamp mounting rails 14 at its first side 11 i.e. at the bottom side of the frame element 10 in the pile driving configuration. The clamp mounting rails 14 extend in a radial direction relative to the vertical direction V, in the pile driving configuration, and to the horizontal direction H perpendicular to the axis of rotation R, in the loading configuration.

In the loading configuration shown in FIG. 2, the clamping device points to the side and is therefore connectable to a head end of a pile that is in a horizontal configuration. This connection can be established by clamping of the pile with the clamping device at a number of points around the perimeter of the pile. In the pile driving configuration shown in FIG. 1, after upending, the pile eventually becomes aligned parallel to the vertical direction V and the first side 11 of the frame element 10 with the clamping device will end up facing down.

The vibratory pile driving apparatus 1 further comprises a clamping device, which is provided at the first side 11 of the frame element 10 and which comprises a plurality of hydraulic clamps, not shown in the figures. The clamps are configured to grip an upper edge of the pile and are configured to be attached to the clamp mounting rails 14 to define a circular pile clamping pattern between them. As such, the vibratory pile driving apparatus 1 is suited to insert or extract monopiles having a circular cross-section. The clamps are slidable along the clamp mounting rails 14 to adjust a diameter of the pile clamping pattern, so that the present vibratory pile driving apparatus 1 can be adjusted for various different types of piles, having different diameters. The diameter of the pile clamping pattern can be increased by moving the clamps in a radially outward direction, to be able to clamp a pile with a relatively large diameter. Similarly, the diameter of the pile clamping pattern can be reduced by moving the clamps in a radially inward direction, to be able to clamp a pile with a relatively small diameter.

During upending, mechanical forces between the crane and the pile can be regarded to bypass the vibrator devices 30. Hence, these loads are transmitted via the clamping device, the frame element 10 and the lifting yoke 20. The upending loads are not transmitted via the vibrator devices 30, which means that the present pile driving apparatus 1 does not suffer from the undesirable loading of resilient dampening elements in the vibrator devices 30.

The lifting yoke 20 is attached to the frame element 10 directly, by means of a hinge device 15 of the frame element 10. The lifting yoke 20 is thus not directly coupled to the vibrator devices 30, but rather indirectly, via the frame element 10. The lifting yoke 20 is in particular attached to a dynamic part of the pile driving apparatus 1, i.e. a part of the pile driving apparatus that is subjected to vibrational loads during use of the apparatus 1 for driving or extracting piles.

The frame element 10 comprises three hinge devices 15. The lifting yoke 20 is attached to the frame element 10 by means of the hinge devices 15. A single hinge device 15 is provided for each respective set of arms of the lifting yoke 20. The hinge devices 15 are configured to effect the mutual rotation between the lifting yoke 20 and the frame element 10 and thereto each comprise a hinge pin 16 extending through holes in the yoke arms of the lifting yoke 20.

The vibratory pile driving apparatus 1 further comprises a hydraulic actuator 40, which is attached to the frame element 10, at an actuator fixture 17 of the hinge device 15, and to an actuator fixture 24 of the lifting yoke 20. The actuator 40 is configured to move the frame element 10 relative to the lifting yoke 20 between the loading configuration and the pile driving configuration. The hydraulic actuator 40 is a hydraulic cylinder 40 and is configured to effect a mutual displacement between the actuator fixture 17 of the hinge device 15 and the actuator fixture 24 of the lifting yoke 20.

The axis of rotation R coincides with the combined centre of gravity of the frame element 10 and the vibrator devices 30, in order to reduce the effort needed to rotate the frame element 10 and the vibrator devices 30 relative to the lifting yoke 20.

The lifting yoke 20 further comprises a cable guiding device 22, which is configured to guide cables and hydraulic fluid lines departing from the pile driving apparatus 1. The cable guiding device 22 is attached to the lifting yoke 20 and is thus configured to remain substantially stationary as well, irrespective of a mutual position between the lifting yoke 20 and the frame element 10.

The cable guiding device 22 extends substantially horizontally away from the lifting yoke, in the horizontal direction H substantially perpendicular to the axis of rotation R. In the loading configuration of the vibratory pile driving apparatus 1 shown in FIG. 2, the cable guiding device 22 faces the second side 12 of the frame element 10, which implies that the cables and hydraulic fluid lines are guided away from the vibratory pile driving apparatus 1 in a direction away from the pile that is clamped.

Figure 4:
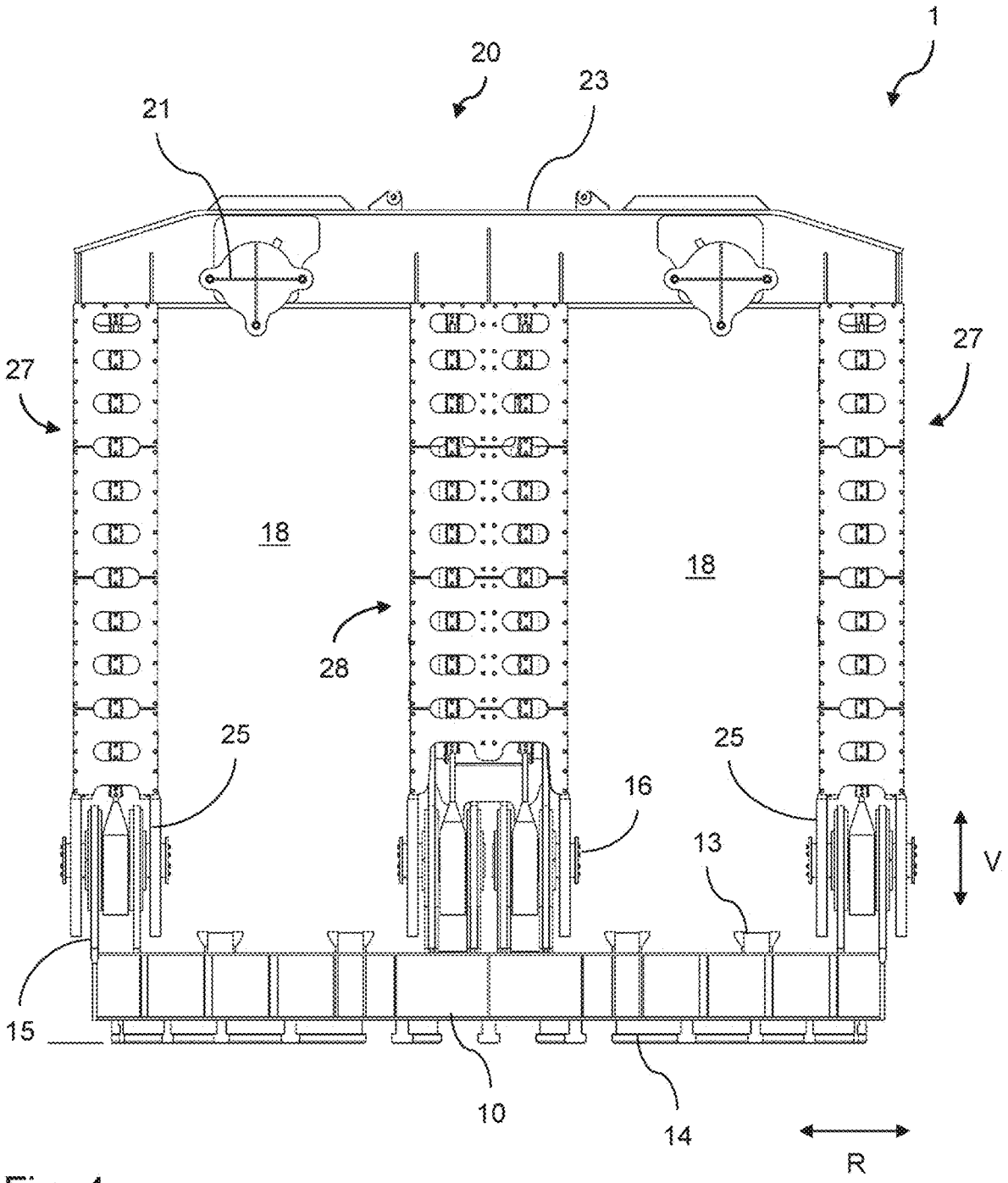
FIG. 4 depicts a front view on the vibratory pile driving apparatus of FIG. 1.

The lifting yoke 20 in the present vibratory pile driving apparatus 1 is subdivided in a dynamic part, which is attached to the frame element 10, and a static part, with which the pile driving apparatus 1 is configured to be suspended from the crane. The lifting yoke 20 comprises a spreader bar 23, which forms part of the static part. The spreader bar 23 extends in a horizontal direction parallel to an axis of rotation R. The spreader bar 23 comprises the lifting trunnions 21, so that the vibratory pile driving apparatus 1 is configured to be suspended from the crane with the spreader bar 23. The spreader bar 23 horizontally spans above the frame element 10, having a width along the axis of rotation R substantially corresponding to a width of the frame element 10, as is best shown in FIG. 4.

As a result of the lifting yoke 20 comprising both a static part and a dynamic part, it is still desired to inhibit transmission of vibrations from the dynamic part towards the crane. To this effect, the lifting yoke 20 comprises a plurality of resilient dampening elements 50. These dampening elements 50 are functionally arranged in between the dynamic part and the static part, to inhibit transmission of vibrations from the dynamic part to the static part and thus to inhibit transmission of vibrations to the crane.

The lifting yoke 20 is thereto configured to dampen relative movements between the dynamic part of the lifting yoke 20 and the static part thereof with the dampening elements 50. The dampening elements 50 are thereby configured to deform in a direction substantially parallel to the vertical direction V during use, since the lifting yoke 20 remains in a substantially vertical orientation both in the loading configuration and the pile driving configuration, and in all relative positions of the lifting yoke 20 between these configurations. The dampening elements 50 are positioned to be able to accommodate deformations in the vertical direction V, to be able to dampen vibrations from the vibrator devices 30 in the vertical direction V. As a result, the dampening elements 50 may not be subjected to deformations other than in the vertical direction V, thereby avoiding undesired damaging of the dampening elements 50.

In the present embodiment of the vibratory pile driving apparatus 1, the dampening elements 50 are made of a synthetic rubber material, which is an elastomeric material having resilient properties, thereby being able to deform elastically when loaded. As a result, the deformations of the elastomeric material may be used to compensate for mutual displacements within the lifting yoke 20, i.e. between the dynamic part and the static part, thereby allowing for inhibition of vibrations by the lifting yoke 20. The synthetic rubber material is thereby able to offer desired dampening properties, whilst still offering a strength sufficient for use in a vibratory pile driving apparatus 1.

According to the present embodiment, the lifting yoke 20 comprises a number of downward yoke arms 25, which are attached to the spreader bar 23 and which form part of the static part of the lifting yoke 20. The downward yoke arms 25 extend away from the spreader bar 23 in a downward vertical direction. The lifting yoke 20 further comprises a number of upward yoke arms 26, which are rotatably attached to the hinge devices 15 and which form part of the dynamic part of the lifting yoke 20.

The upward yoke arms 26 extend away from the frame element 10 and from the hinge devices 15 in an upward vertical direction. The downward yoke arms 25 and the upward yoke arms 26 thus extend in opposite directions, respectively having free lower ends and free upper ends. The dampening elements 50 are attached in between the downward yoke arms 25 and the upward yoke arms 26 and are thereby configured to form a resilient connection between the downward yoke arm 25 and the upward yoke arm 26 to inhibit transmission of vibrations between them.

The dampening elements 50 in between the downward yoke arms 25 and the upward yoke arms 26 are subjected to shear forces, following mutual vertical displacements between the downward yoke arms 25 and the upward yoke arms 26, since they are loaded in a substantially vertical direction V. Accordingly, the dampening elements 50 are configured to accommodate mutual shear strains between the downward yoke arms 25 and the upward yoke arms 26.

Each one of the downward yoke arms 25 at least partially faces one or more of the upward yoke arms 26, i.e. overlapping with each other partly in a vertical plane. Part of the downward yoke arm 25 thus lies directly opposite to part of the upward yoke arm 26, seen in a vertical plane. The dampening elements 50 are attached in between these overlapping parts of the yoke arms 25, 26. The downward yoke arms 25 and upward yoke arms 26 that face each other with dampening elements 50 in between them are defined herein as sets of yoke arms 25, 26.

Figure 5A:
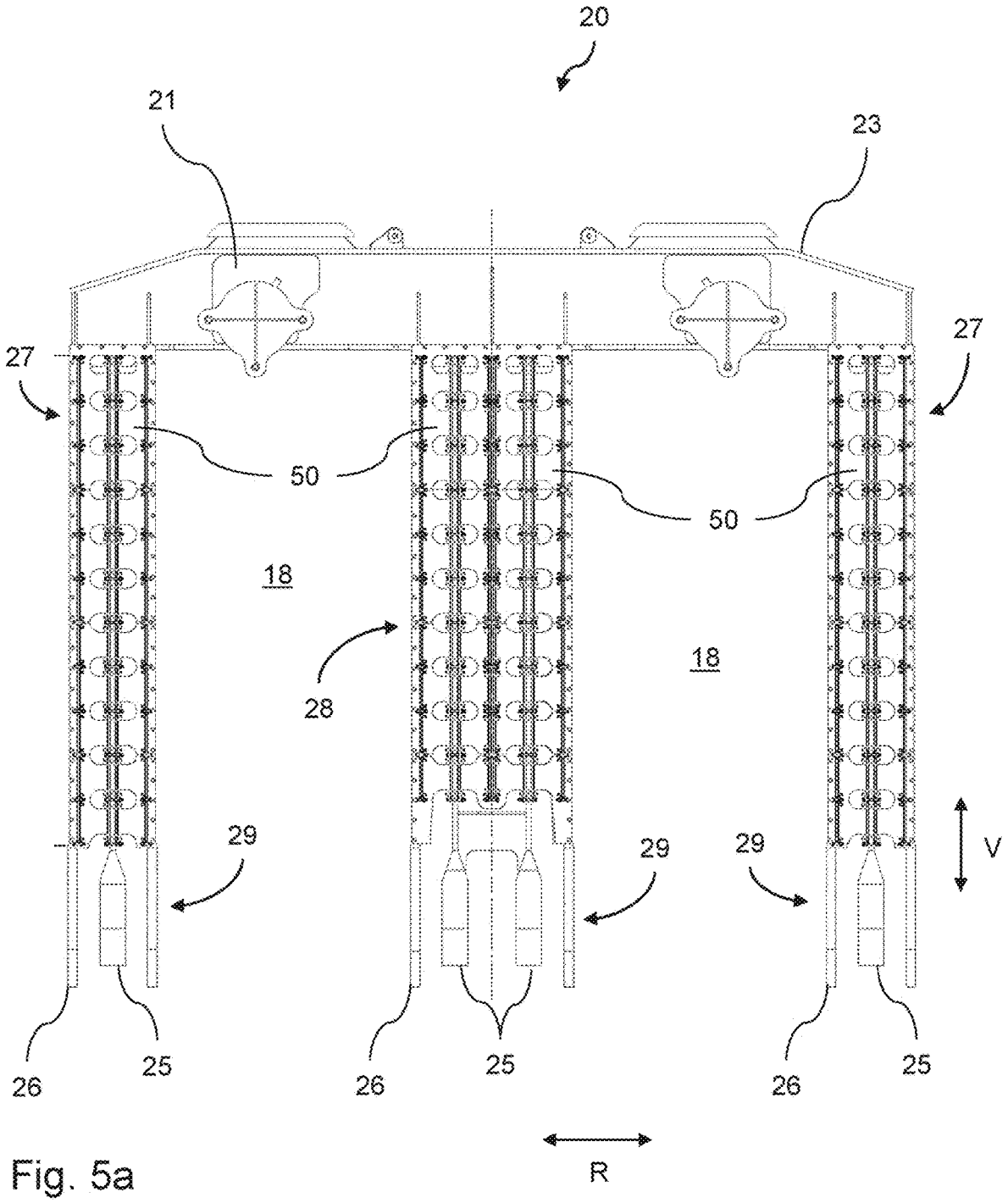
FIG. 5*a* depicts a front view on the lifting yoke of the vibratory pile driving apparatus of FIG. 1.

In the present embodiment, the lifting yoke 20 comprises two opposed sideward sets 27 of yoke arms 25, 26, as is best shown in FIG. 5*a*. The sideward sets 27 of yoke arms 25, 26 are provided at opposite ends of the spreader bar 23 and are formed by downward yoke arms 25 that downwardly extend from the spreader bar 23 and by the upward yoke arms 26 that are arranged at opposite sides of the frame element 10.

Each sideward set 27 of yoke arms 25, 26 comprises two downward yoke arms 25 and a single upward yoke arm 26, which are aligned parallel to each other and which are spaced at a distance from each other. A spacing is present between the downward yoke arms 25, in which the upward yoke arm 26 is provided, centrally in between the downward yoke arms 25.

For each of the sideward sets 27 of yoke arms 25, 26, the lifting yoke 20 comprises a respective dampening element 50 in between the central upward yoke arm 26 and each of the outer downward yoke arms 25. This configuration offers symmetric loading of the sideward sets 27 of yoke arms 25, 26 and provides that the dampening elements 50 at the opposite sides of the central upward yoke arm 26 are loaded in parallel.

The lifting yoke 20 further comprises a central set 28 of yoke arms 25, 26, which is located centrally in between the opposed sideward sets 27 of yoke arms 25, 26. The central set 28 of yoke arms 25, 26 comprises three downward yoke arms 25 that are spaced at a distance from each other along the axis of rotation R, defining two spacings in between them. Accordingly, the central set 28 of yoke arms 25, 26 comprises two upward yoke arms 26, each projecting in a respective spacing between the downward yoke arms 25. The central set 28 of yoke arms 25, 26 comprises four dampening elements 50, which are provided side by side between the yoke arms 25, 26 of the central set 28. These four dampening elements 50 are loaded in parallel to each other and in parallel to the dampening elements 50 in the sideward sets 27 of yoke arms 25, 26, to further increase the loads that can be transmitted between the downward yoke arms 25 and the upward yoke arms 26.

With the central set 28 of yoke arms 25, 26 being present, the space between the sideward sets 27 of yoke arms 25, 26 is subdivided in two space parts 18. The vibrator mounting rails 13 project in these space parts 18, so that the vibrator devices 30 are arranged on opposite sides of the central set 28 of yoke arms 25, 26. The placement of vibrator devices 30 on these vibrator mounting rails 13 allows that rotation of the frame element 10 relative to the lifting yoke 20 is not obstructed by the vibrator devices 30 colliding with the lifting yoke 20. Furthermore, each of these space parts 18 comprises an equal number of vibrator devices 30, as is best shown in FIG. 7, to obtain a substantially symmetrical vibratory pile driving apparatus 1.

Figure 5B:
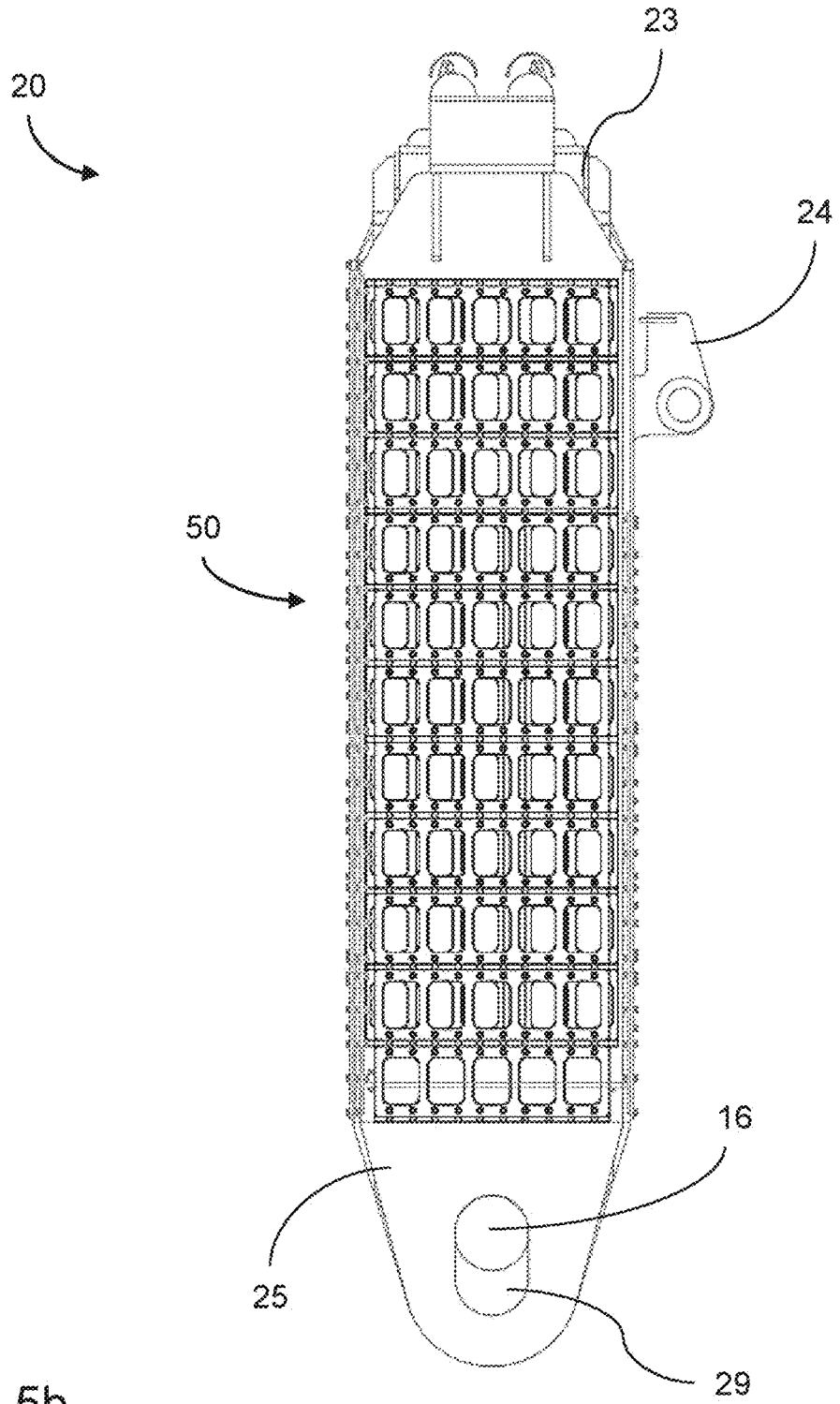
FIG. 5*b* depicts a side view on the lifting yoke of FIG. 5*a*, FIGS. 6*a*-6*c* depict various different embodiments of a dampening cassette for use in the vibratory pile driving apparatus of FIG. 1.

It is furthermore shown best in FIG. 5*b* that all downward yoke arms 25 vertically project beyond their respective hinge devices 15 and that the downward yoke arms 25 each comprise a slotted hole 29 that is substantially elongate in the vertical direction V. The hinge pins 16 project through the slotted holes 29 in the downward yoke arms 25, but do not contact the downward yoke arms 25 during normal use of the vibratory pile driving apparatus 1, i.e. during upending and during vibrating.

The slotted holes 29 are configured to only contact the downward yoke arms 25 in case of failure of one or more of the dampening elements 50. Hence, this could cause the normal connection between the upward yoke arms 26 and downward yoke arms 25 via the dampening elements 50 to break, resulting in a drop of the frame element 10 relative to the lifting yoke 20. The hinge pin 16 may then become supported in the slotted hole 29 of the downward yoke arm 25, which thus offers an emergency support.

In the vibratory pile driving apparatus 1 shown in the figures, the dampening elements 50 are modular dampening cassettes 50. Several examples of these dampening cassettes 50 are displayed in FIGS. 6*a*-6*c*. Each of these dampening cassettes 50 comprises a changeable number of dampers 52, which are deformable in parallel to each other. The dampening cassettes 50 comprise a number of dampers 52 that corresponds to a height or width of the overlap between the upward yoke arm 26 and the downward yoke arm 25 with which they are associated.

In the vibratory pile driving apparatus 1 according to the present invention, a single dampening cassette 50 is provided between each opposed downward yoke arm 25 and upward yoke arm 26. The sideward set 27 of yoke arms 25, 26 comprises a single upward yoke arm 26 in between two downward yoke arms 26 and therefore comprises two dampening cassettes 50, i.e. one at each side of the upward yoke arm 26. The central set 28 of yoke arms 25, 26, on the other hand, comprises two upward yoke arms 26 in between three downward yoke arms 25 and therefore comprises four dampening cassettes 50, i.e. one at each side of both upward yoke arms 26.

Figure 6A:
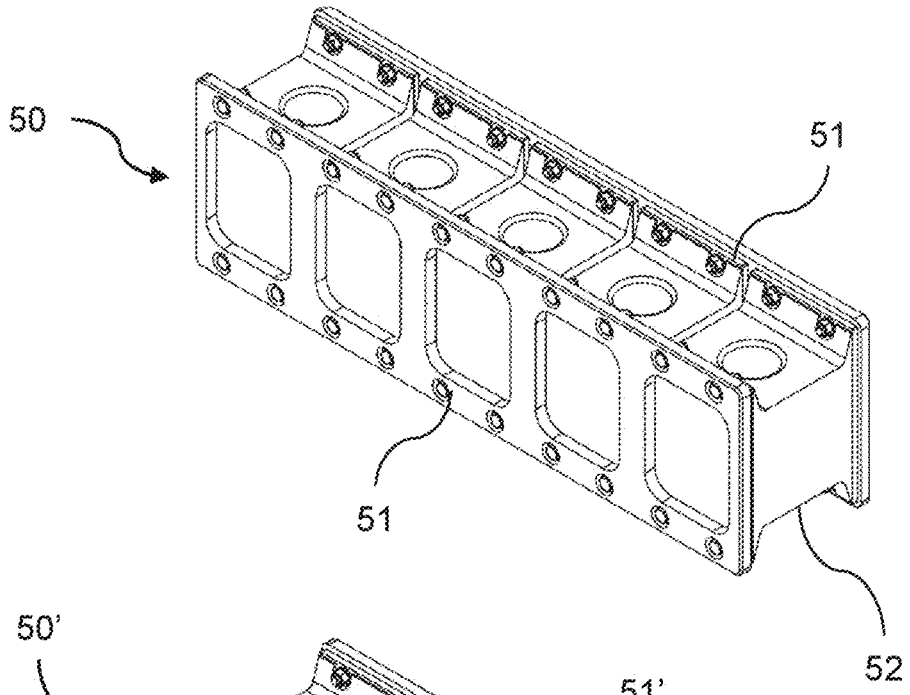
Figure 6B:
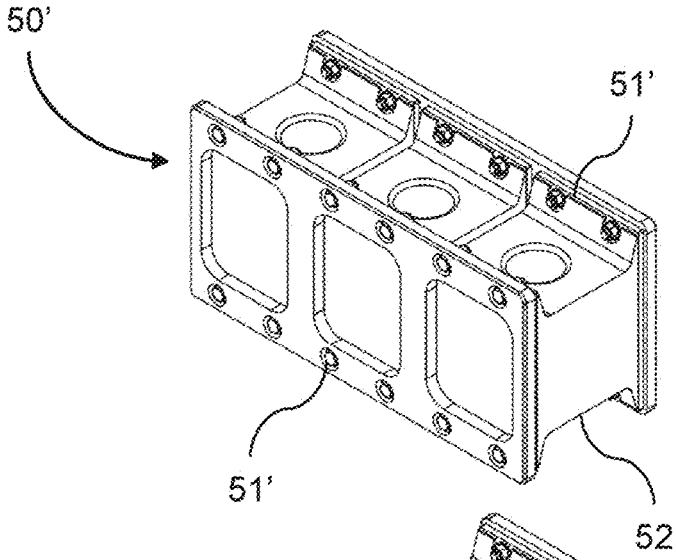
Figure 6C:
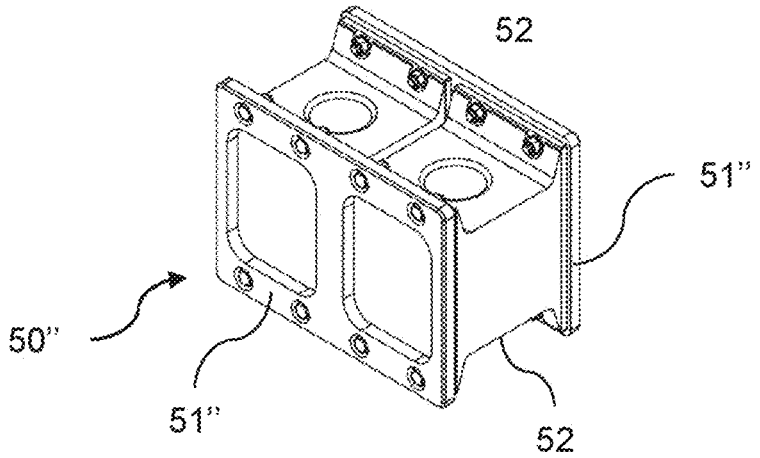

The dampening cassette 50 in FIG. 6*a* comprises five dampers 52, which are mounted in between two opposed cassette frames 51 having five corresponding mounting positions. The dampening cassettes 50', 50" in FIGS. 6*b* and 6*c* respectively comprise three dampers 52*s* and two dampers 52, which are mounted in between two opposed cassette frames 51', 51" having three and two corresponding mounting positions.

The dampening cassette 50 in FIG. 6*a* has a relatively large number of dampers 52 and is thus preferably applicable for lifting yokes of which the yoke arms overlap over a relatively large distance. However, when the yoke arms only overlap over a small distance, the relatively small dampening cassettes from FIGS. 6*b* and 6*c* may be applied, comprising a relatively small number of dampers.

Figures 8A, 8B:
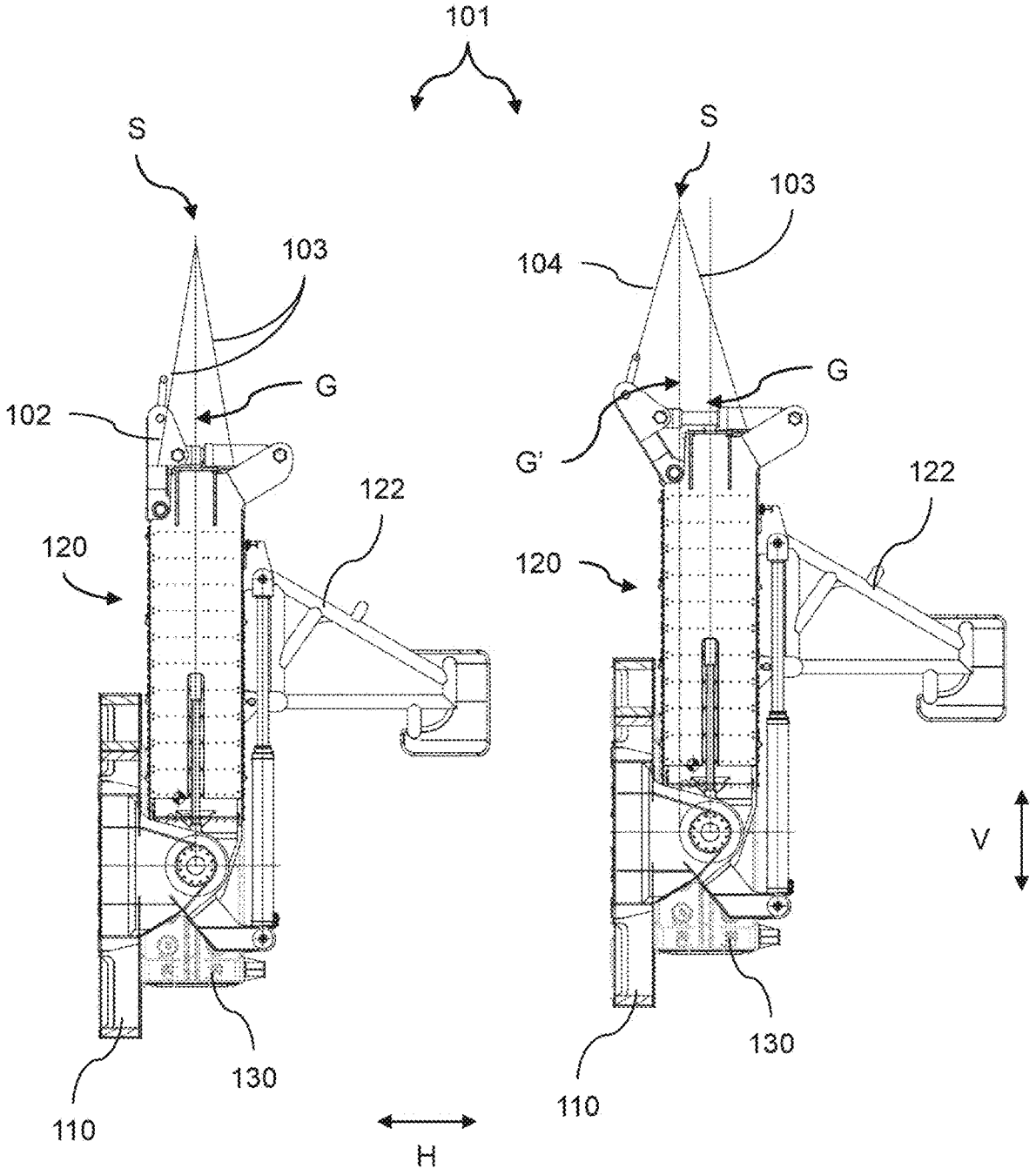

FIGS. 8*a* and 8*b* schematically depict a further embodiment of the vibratory pile driving apparatus according to the present invention from the side, to which is referred with reference numeral 101. This vibratory pile driving apparatus 101 comprises all components of the vibratory pile driving apparatus 1 shown in FIGS. 1-6, and additionally comprises a lifting corrector arm 102.

This embodiment of the vibratory pile driving apparatus 101 further comprises an even number primary lifting lines 103, of which two are visible in the side view in FIGS. 8*a* and 8*b*. The primary lifting lines 103 are embodied as lifting cables and are attached to the lifting yoke 120. The primary lifting lines 103 are configured to be attached to a crane for suspending the vibratory pile driving apparatus 101.

Figure 9A:
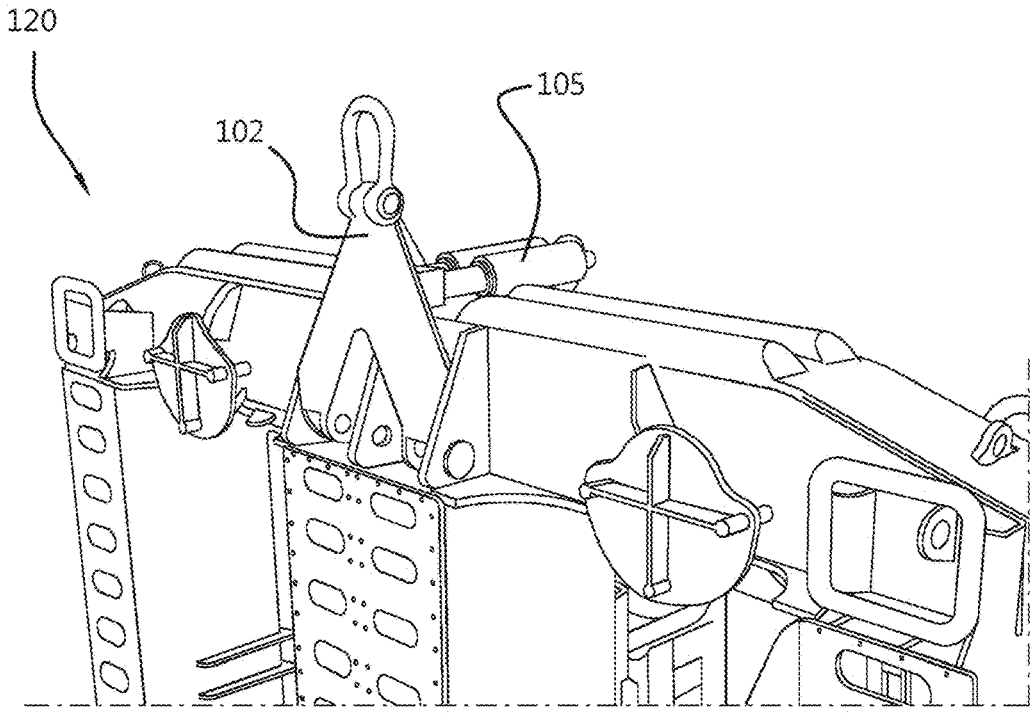
FIGS. 9*a* and 9*b* depict a close-up view on the lifting corrector arm of the vibratory pile driving apparatus of FIGS. 8*a* and 8*b*.
Figure 9B:
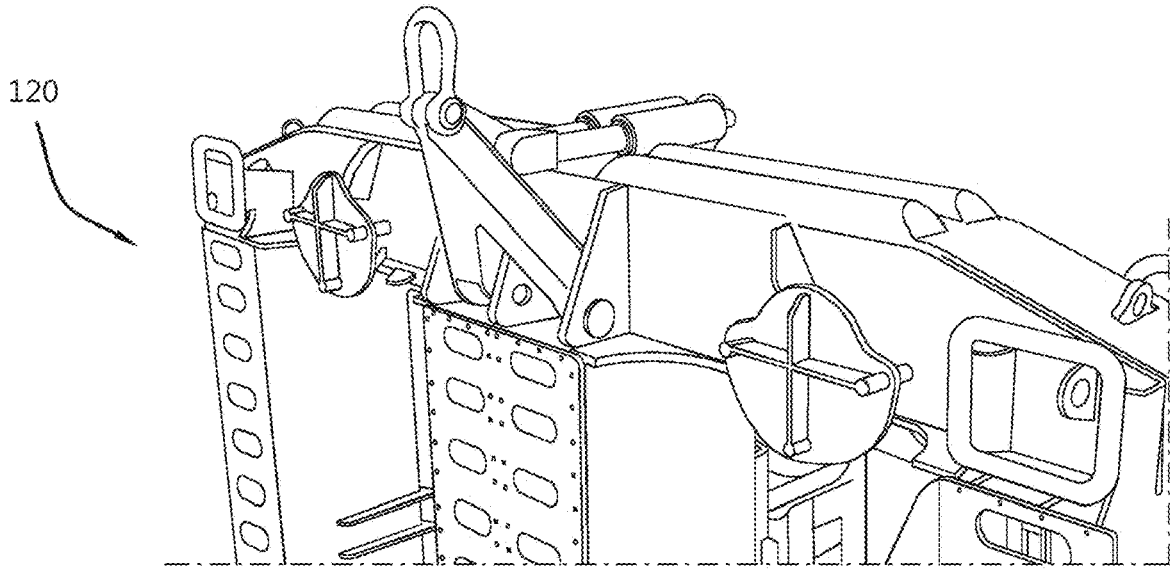

The lifting corrector arm 102 is attached to the lifting yoke 120 and is rotatable relative to the lifting yoke 120 between an inner position, shown in FIG. 8*a* and in FIG. 9*a*, and an outer position, shown in FIG. 8*b* and in FIG. 9*b*. The vibratory pile driving apparatus 101 comprises two hydraulic actuators 105 for moving the lifting corrector arm 102 relative to the lifting yoke 120.

The vibratory pile driving apparatus 101 further comprises an auxiliary lifting line 104, which is attached to the lifting corrector arm 102 and which is configured to be attached to the crane as well. The lifting corrector arm 102 and the auxiliary lifting line 104 are together configured to shift a suspension point S the vibratory pile driving apparatus 101 relative to a vertical axis G through the centre of gravity of the vibratory pile driving apparatus 101.

In the inner position of the lifting corrector arm 102, shown in FIG. 8*a*, the entire weight of the vibratory pile driving apparatus 101 is suspended by the primary lifting lines 103. In this inner position, the suspension point S of the vibratory pile driving apparatus 101, i.e. the point where the lifting lines 103, 105 are attached to the crane, are aligned vertically above the centre of gravity of the vibratory pile driving apparatus 101.

In the outer position of the lifting corrector arm 102, shown in FIG. 8*b*, the auxiliary lifting line 105 is tensioned and part of the weight of the vibratory pile driving apparatus 101 becomes suspended by the auxiliary lifting line 105. In this configuration, at least one of the primary lifting lines 103 becomes relaxed.

Due to the outward movement of the lifting corrector arm 102 towards the outer position, the suspension point S of the vibratory pile driving apparatus 101 is shifted relative to the centre of gravity of the vibratory pile driving apparatus 101. The suspension point S thereby becomes aligned with a vertical axis G' offset relative to the centre of gravity of the vibratory pile driving apparatus 101. As such, the stability of the vibratory pile driving apparatus 101 is adjusted.

The invention claimed is:

1. Vibratory pile driving apparatus for upending a pile and for driving a pile into the ground and/or extracting a pile out of the ground, the apparatus comprising:

a frame element, a clamping device, attached to the frame element at a first side thereof and configured to clamp the pile, at least one vibrator device, attached to the frame element at a second side, opposite to the first side, and configured to subject the frame element and the clamping device to a vibratory load, and a lifting yoke, rotatably connected to the frame element, wherein the pile driving apparatus is configured to be suspended from a crane by the lifting yoke during use, wherein the lifting yoke is configured to be rotated relative to the frame element to move the pile driving apparatus between a loading configuration and a pile driving configuration, and wherein the lifting yoke comprises one or more dampening elements, which are, during use, configured to deform to inhibit transmission of vibrations to the crane.

2. Vibratory pile driving apparatus according to claim 1, wherein the one or more dampening elements are configured to deform in a vertical direction during use.

3. Vibratory pile driving apparatus according to claim 1, wherein the lifting yoke further comprises:

a dynamic part, which is attached to the frame element, and a static part, with which the pile driving apparatus is configured to be suspended from the crane, and wherein the one or more dampening elements are functionally arranged in between the dynamic part and the static part, to inhibit transmission of vibrations from the dynamic part to the static part.

4. Vibratory pile driving apparatus according to claim 3, wherein the static part comprises a downward yoke arm, extending in a downward vertical direction, wherein the dynamic part comprises an upward yoke arm extending in a downward vertical direction, wherein the downward yoke arm and the upward yoke arm at least partially face each other to form a set of yoke arms, and wherein the one or more dampening elements are attached in between the downward yoke arm and the upward yoke arm.

5. Vibratory pile driving apparatus according to claim 4, each set of yoke arms comprising at least two downward yoke arms, wherein the upward yoke arm is arranged centrally in between the downward yoke arms and wherein the lifting yoke comprises at least one respective dampening element in between the central upward yoke arm and each of the downward yoke arms, or each set of yoke arms comprising at least two upward yoke arms, wherein the downward yoke arm is arranged centrally in between the upward yoke arms and wherein the lifting yoke comprises at least one respective dampening element in between the central downward yoke arm and each of the upward yoke arms.

6. Vibratory pile driving apparatus according to claim 4, wherein the static part further comprises a spreader bar, extending in a horizontal direction parallel to an axis of rotation between the lifting yoke and the frame element, and wherein opposed sideward sets of yoke arms are provided at opposite ends of the spreader bar, formed by the downward yoke arms that downwardly extend from the spreader bar and by the upward yoke arms that are arranged at opposite sides of the frame element.

7. Vibratory pile driving apparatus according to claim 6, wherein the lifting yoke further comprises a central set of downward yoke arms and upward yoke arms, which is located centrally in between the opposed sideward sets of yoke arms.

8. Vibratory pile driving apparatus according to claim 1, wherein the one or more dampening elements are made of an elastomeric material.

9. Vibratory pile driving apparatus according claim 1, wherein the one or more dampening elements are modular dampening cassettes, comprising a changeable number of dampers, which are deformable in parallel to each other.

10. Vibratory pile driving apparatus according to claim 1, wherein the frame element further comprises at least one hinge device, wherein the lifting yoke is attached to the frame element by means of the at least one hinge device.

11. Vibratory pile driving apparatus according to claim 10, further comprising an actuator which is attached to the frame element and the lifting yoke and which is configured to move the lifting yoke relative to the frame element between the loading configuration and the pile driving configuration.

12. Vibratory pile driving apparatus according to claim 1, wherein the lifting yoke further comprises a cable guiding device, configured to guide cables and/or hydraulic fluid lines departing from the pile driving apparatus.

13. Vibratory pile driving apparatus according to claim 1, wherein the frame element comprises a plurality of clamp mounting rails at its first side, wherein the clamp mounting rails extend in a radial direction relative to the vertical direction, wherein the clamping device comprise two or more clamps, which are attached to the clamp mounting rails to define a pile clamping pattern, between them, and wherein the clamps are slidable along the clamp mounting rails to adjust a dimension of the pile clamping pattern.

14. Vibratory pile driving apparatus according to claim 1, wherein the frame element comprises one or more vibrator mounting rails at its second side, and wherein the at least one vibrator device is attached to the vibrator mounting rails.

15. Vibratory pile driving apparatus according to claim 14, wherein the vibrator mounting rails extend in a horizontal direction perpendicular to the axis of rotation and wherein the at least one vibrator device is, at least in the loading configuration, arranged in between the opposed sets of yoke arms of the lifting yoke.

16. Method of driving a pile into the ground by means of the vibratory pile driving apparatus according to claim 1, comprising the steps of:

clamping the pile by means of the clamping device, moving the pile to a location where it is to be driven in the ground, and subjecting the pile to vibrations with the at least one vibrator device.

17. Method according to claim 16, wherein the step of clamping is carried out with the pile driving apparatus in the loading configuration, wherein the method further comprises the step of upending of the pile from a horizontal orientation into a vertical orientation, prior to driving it into the ground, wherein the step of upending comprising lifting the pile driving apparatus and the pile and rotating the pile driving apparatus towards the pile driving configuration during the lifting, to bring the pile from the substantially horizontal orientation into the substantially vertical orientation.

18. Method of extracting a pile out of the ground by means of the vibratory pile driving apparatus according to claim 1, comprising the steps of:

clamping the pile by means of the clamping device, subjecting the pile to vibrations from the at least one vibrator device, and pulling the pile in an upward vertical direction with the pile driving apparatus.

* * * * *